United States Patent [19]

Daspit

[11] 4,224,653

[45] Sep. 23, 1980

[54] RELEASABLE MAGNETIC ATTACHMENT FOR UNDERWATER DIVER'S HOSE AND THE LIKE

[76] Inventor: Ronald A. Daspit, 2013 Todd Dr., Poydras, La. 70085

[21] Appl. No.: 519

[22] Filed: Jan. 2, 1979

Related U.S. Application Data

[63] Continuation of Ser. No. 802,138, May 31, 1977, abandoned.

[51] Int. Cl.[2] ..... H02H 5/10

[52] U.S. Cl. ..... 361/144; 248/75; 335/285; 335/289; 361/1

[58] Field of Search ..... 361/1, 144, 145; 335/285, 289, 290, 291, 292, 294; 211/DIG. 1; 339/12 R; 248/206 A, 206 R, 49, 58, 75, 79, 64, 317, 360, 320, 359, 363; 294/88, 65.5

[56] References Cited

U.S. PATENT DOCUMENTS

| | | | |
|---|---|---|---|
| 1,554,236 | 9/1925 | Simmons | 335/289 |
| 2,347,369 | 4/1944 | Roters | 361/144 X |
| 2,939,671 | 6/1960 | Beekman | 248/75 X |
| 2,970,857 | 2/1961 | Squire | 335/285 X |

*Primary Examiner*—Patrick R. Salce
*Attorney, Agent, or Firm*—Charles Richard Werner

[57] ABSTRACT

A releasable magnetic attachment for underwater diver's hose and the like utilizing pneumatic, hydraulic or electromagnetic release actuating means operable by the diver or by an operator on a tender on the surface of the water, or a manual release operable by the diver underwater.

3 Claims, 3 Drawing Figures

RELEASABLE MAGNETIC ATTACHMENT FOR UNDERWATER DIVER'S HOSE AND THE LIKE

This is a continuation of Ser. No. 802,138, filed May 31, 1977, now abandoned.

BRIEF SUMMARY OF THE INVENTION

Insofar as I am aware, in the art of diver's equipment, the standard practice is to use an air hose as well as a life line and perhaps a communication cable, all of which, when a diver is at considerable depth, creates a drag which impedes movement of the diver and can cause interference or slowing down of his ability to perform his work. Scuba type breathing apparatus is also used in diving operations but this invention does not contemplate or encompass operations using scuba equipment.

A diver working at great depths or who is subjected to water currents encounters considerable pull or drag created by the hose and movement of the water. This drag hinders his ability to work with ease and frequently creates a hazard should he find it necessary to surface rapidly in the event of an emergency, it being standard practice to employ considerable slack in the hose for free movement of the diver in his work or for moving from place to place along the bottom. Furthermore, all the slack in a hose or life line must be taken up before the diver can begin his ascent to the surface. In an emergency this time lag can be dangerous to the diver. Furthermore, this slack in the hose is hazardous because of the possibility of entanglement with various foreign objects such as trees, debris or the like, particularly when working in rivers in which the current is apt to be carrying such debris.

A diver often is required to physically inspect great lengths of submerged pipeline (termed "walking the pipeline") and during this operation the boat slowly follows the diver as he progresses along the pipeline, this type of operation requiring an excess of slack in the hose so as not to impede the progress of the diver. This excess of hose creates a considerable amount of drag due to the friction of the water and also creates the hazard of possible entanglement with the boat's propeller or rudder.

It is also a practice employed by some divers to secure the diving hose to weighted cables or ropes or the like or to secure said cables to some immovable object to reduce the drag on the hose. This arrangement does not permit rapid release of the hose in the event of emergency and is considered hazardous, with most divers refusing to work under such conditions.

It is therefore one object of my invention to provide an instantly releasable magnetic attaching device for the diver's hose which may be secured to said hose or life line at a reasonable distance from the diver in order to eliminate the drag of any great length of said hose, said attaching device being capable of being secured to any metallic object such as the hull of a ship, a pipeline, sheet pile bulkhead or offshore drilling platform or the like.

It is a further object of my invention to provide release means for the attaching device, said release means comprising a manually operated cam lever; an electromagnet operated either by the diver or by an operator at the surface of the water; or by pneumatic or hydraulically operated means.

BRIEF DESCRIPTION OF THE DRAWINGS

Other objects and advantages will be evident by reference to the following specifications in relation to the accompanying drawings, in which.

DETAILED DESCRIPTION OF THE INVENTION

Figure 1:
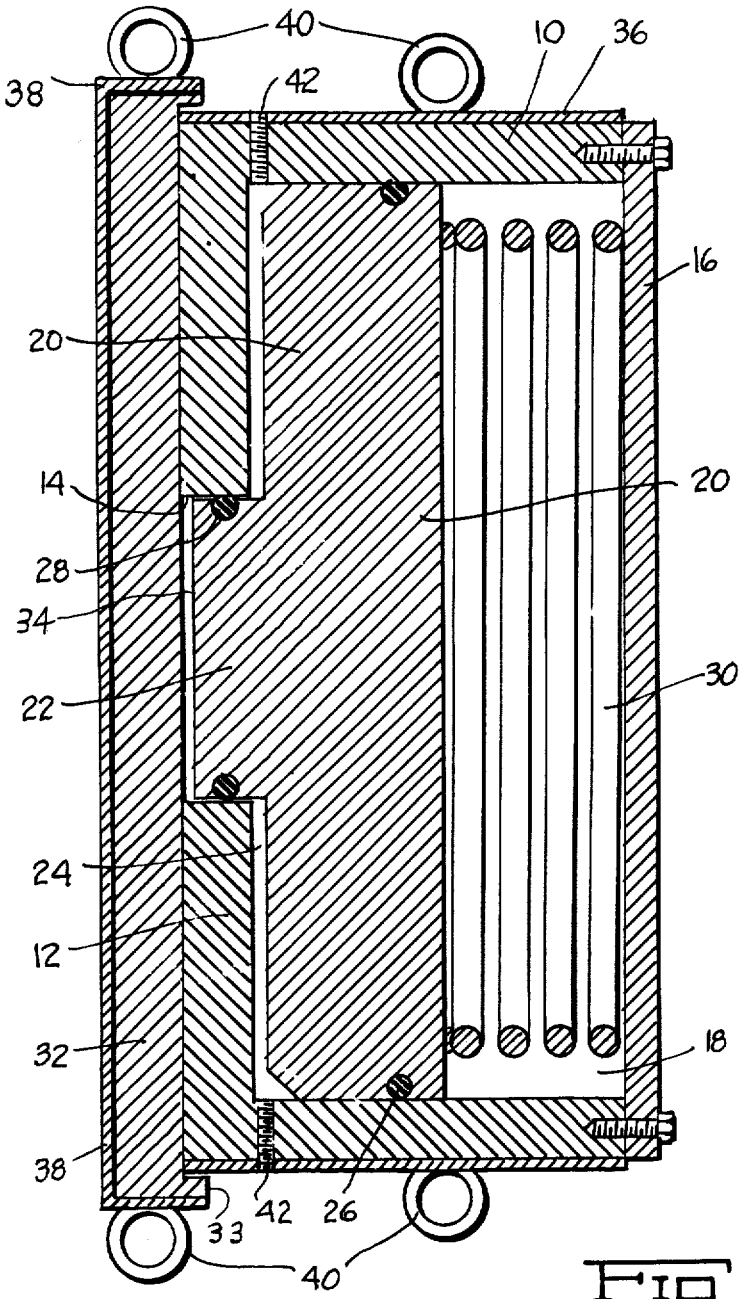
FIG. 1 is a cross sectional view through an attaching device operated by pneumatic or hydraulic means, parts being shown in elevation.

Referring now to FIG. 1 in which a pneumatic or hydraulic type of attaching device is shown, it being deemed sufficient to show only the sectional view, reference numeral 10 refers to a casing made of a magnetically attractive material, preferably circular in shape, one side 12 of the casing having a reduced aperture 14 and the other side of the casing receiving a removable cover 16, which combination of casing, side 12 and cover 16, provides an internal chamber 18 in which a nonmagnetic piston 20 is located, said piston having a reduced plunger 22 centrally located and adapted to be movably received in the reduced aperture 14, a space 24 being provided between the plunger and the side 12 of the casing to provide for reception of a fluid and for a sufficient degree of movement of the piston 20 as will be explained hereinafter.

O-ring seals 26 and 28 are provided on the piston 20 and the reduced plunger 22 and a spring 30 under compression is seated between the piston 20 and the cover 16 and normally urges the piston 20 toward the side 12 of the casing.

A magnetic plate 32 is attracted to the casing 10 and may be contacted by the surface 34 of the reduced plunger 22 as well as the side 12 of the casing 10. A nonmagnetic shell 36 surrounds the casing 10 and the magnetic plate 32 is also covered with a nonmagnetic shell 38. Suitable padeyes 40 are provided on both shells 36 and 38 for attaching safety hose, line, conductors and other lines between the boat on the surface and the diver or to tools and devices used by the diver.

Suitable hydraulic connections 42 are hermetically sealed to the casing and open into the space 24 for introduction and removal of air or other fluid to permit attachment and detachment of the magnetic plate 32 to and from the side 12 of the casing.

As will be obvious from the construction shown the spring 30 under compression tends to force the reduced plunger 22 toward the magnetic plate 32 in an endeavor to release said magnetic casing 10 from the magnetic plate 32. However, while air or fluid is being forced under pressure into the space 24, the magnetic plate 32 will remain attached to the magnetic casing 10. Operation of the device can be by the diver through a suitable control (not shown) connected to one of the connections 42 or by a control line (not shown) leading up to the boat.

The various hoses, lines, etc., are suitably connected to the padeyes 40 and the entire device can be magnetically attached to a ship's hull, to a pipe line, or any other available metallic surface near where the diver is working and only a short length of hose or line is needed between the diver and the magnetic device, making it much easier for him to move about without the hindrance of hundreds of feet of such hose or line. In an emergency he can easily and quickly be released from the magnetic device by actuating the control to reduce the pressure within space 24 and permit the plunger 22 to force the magnetic casing 10 away from the metallic plate 32.

Figure 2:
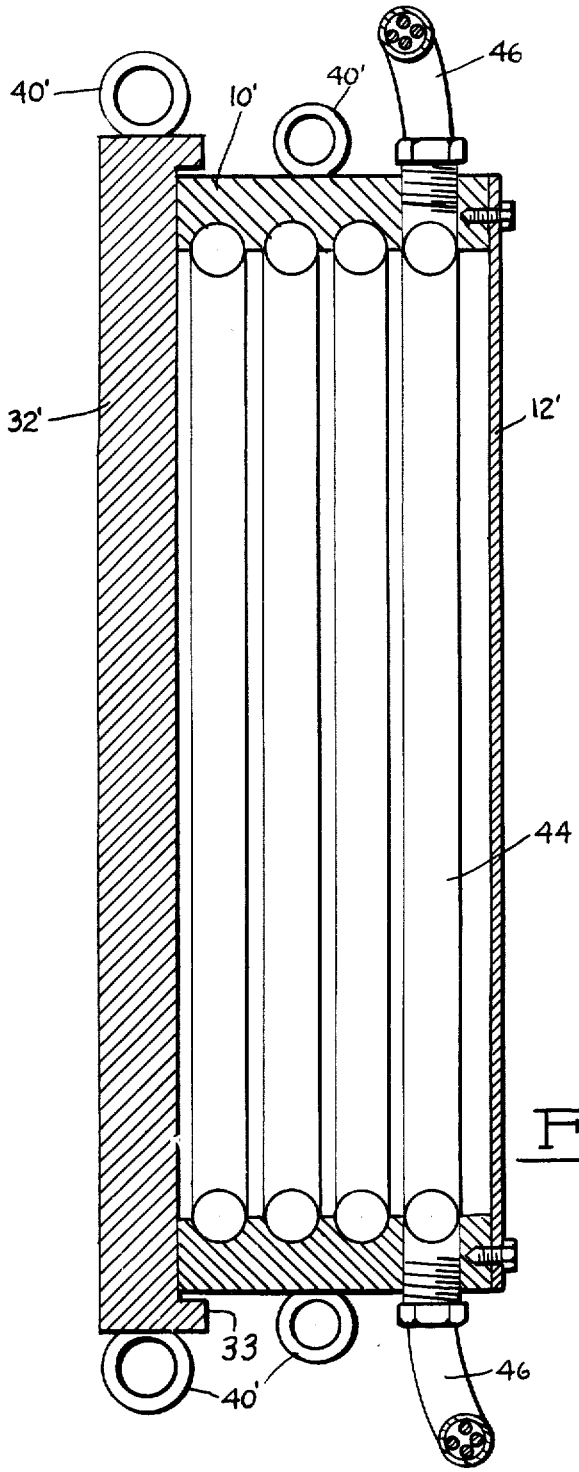
FIG. 2 is a similar view through a fastening or attaching device operated by means of an electromagnet.

In another form of my invention shown in FIG. 2, a casing 10' with cover 12' contains an electromagnet 44 with sealed electrical conductors 46 connected to the electromagnet and leading out of the casing 10', one to the diver and the other to the boat on the surface, so that the electromagnet can be controlled by the diver or by the operator on the boat.

A magnetically influenced plate 32' is attracted to the electromagnet 44 in the casing 10' when it is actuated and is released the instant the electromagnet is deactuated. Suitable padeyes 40' are provided and the operation and use of the electromagnetic type of device is the same as the hydraulic or pneumatic type.

Figure 3:
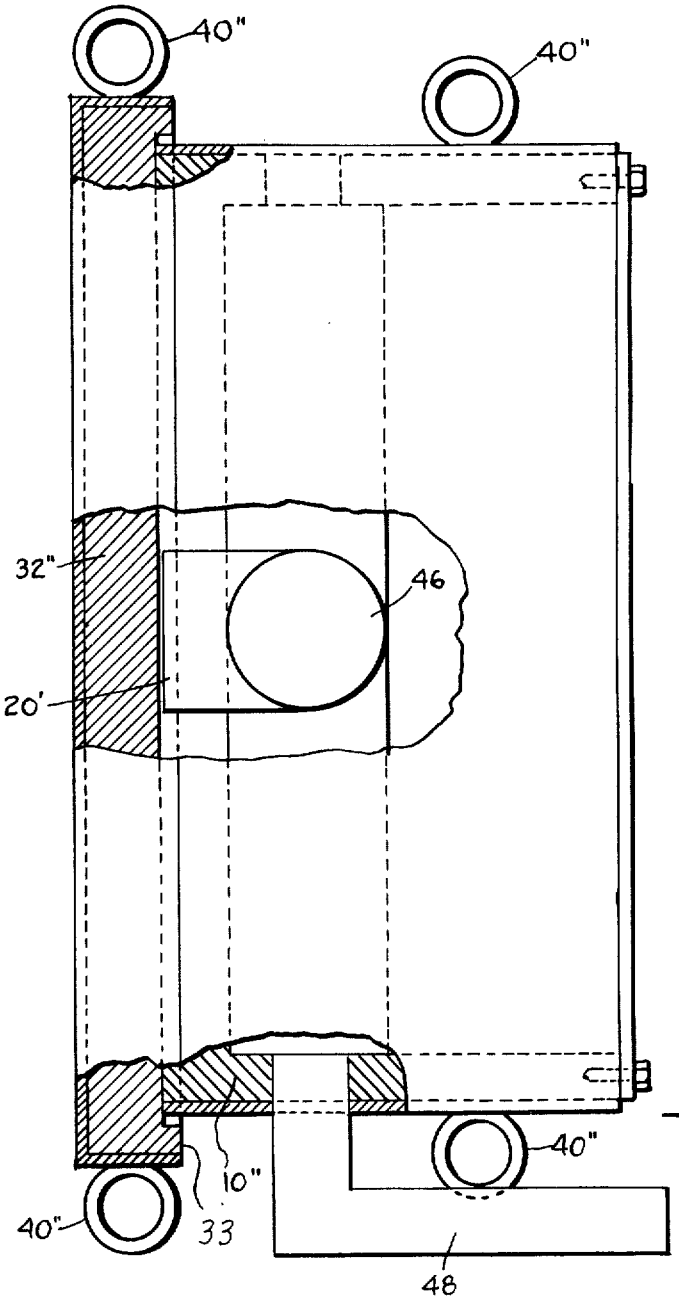
FIG. 3 is another view similar to 1 and 2 in which a cam actuator is used to separate the fastening device from the magnet attracted to the metal surface.

The device shown in FIG. 3 is a manually operated device with a hermetically sealed piston 20' within the casing 10'', a cam 46 with related lever 48 being employed to disengage the casing 10'' from the magnetic plate 32''. Padeyes 40'' are provided for the same purpose as in the other forms of my invention. This model of my invention requires manual release by the diver but is less costly to manufacture.

In all forms of my invention the plates 32, 32' and 32'' are provided with overlapping peripheral members 33, in the form of a flange or spaced members of any other suitable shape to prevent lateral movement of said plates in relation to the casing 10, 10' or 10''.

From the foregoing it will be seen that I have provided a relatively simple magnetic attachment for underwater diver's use in attachment of a major portion of his life line hose, other cables and conductors, etc., to relieve him of the strain and obstruction of endeavoring to perform his tasks with the burden of great lengths of such hose, lines and the like, permitting him to move about with only short lengths thereof, and further providing him with quick release means should an emergency arise and it becomes urgent that he surface as rapidly as possible. The device in each of its forms can be moved by the diver from location to location and along a pipe line permitting him a wide range of underwater operation with no hindrance by the hose. Use of this device eliminates danger from underwater currents, danger from entanglement with debris as immediate release can be achieved should such entanglement occur.

It is obvious that changes in form, proportion and details of construction may be resorted to without departing from the spirit of my invention and I reserve all rights to such changes as come within the scope of these specifications and the claims which follow.

What I claim as new and desire to secure by Letters Patent is:

1. A releasable magnetic attachment for underwater diver's hose and the like comprising a hermetically sealed casing, a separable magnetic plate attached to the casing by its magnetic attraction, a nonmagnetic movable piston sealed within the casing, a portion of the piston being projectable from the casing and in normally nonactuating relation to the magnetic plate, at least a portion of the casing facing the magnetic plate being of magnetically attractable material, and means for moving the piston to disengage the magnetic plate from the casing.

2. The releasable magnetic attachment for underwater diver's hose and the like, as described in claim 1, including a chamber within the casing, a piston movable in said chamber, a spring under compression in said chamber between one side thereof and the piston urging said piston in one direction, an aperture in the opposite side of said chamber, pressure controlled fluid conductible into the chamber between the last mentioned opposite side of the chamber and the piston, at least a portion of said piston extending through said aperture and in contact with the magnetic plate, release of the fluid pressure permitting the spring to force the portion of said piston against the magnetic plate to release same from the casing.

3. A releasable magnetic attachment for underwater diver's hose and the like, comprising an electromagnet hermetically sealed within a casing, a separable magnetically attractible plate attachable to the casing upon energizing said electromagnet, a peripheral member about the magnetically attractible plate, said member being adapted to bear against the exterior surface of said casing to maintain said plate against lateral sliding movement relative to said sealed casing, and means for energizing and deenergizing the electromagnet to magnetically secure the plate to the casing or release the plate from the casing.

* * * * *